US009464474B2

(12) United States Patent
Watson

(10) Patent No.: US 9,464,474 B2
(45) Date of Patent: Oct. 11, 2016

(54) DOOR BUCK

(71) Applicant: Patrick Watson, Chestermere (CA)

(72) Inventor: Patrick Watson, Chestermere (CA)

( * ) Notice: Subject to any disclaimer, the term of this patent is extended or adjusted under 35 U.S.C. 154(b) by 0 days.

(21) Appl. No.: 14/015,129

(22) Filed: Aug. 30, 2013

(65) Prior Publication Data

US 2014/0059954 A1 Mar. 6, 2014

(30) Foreign Application Priority Data

Aug. 31, 2012 (CA) ..... 2788254

(51) Int. Cl.
*E06B 1/04* (2006.01)
*E06B 1/02* (2006.01)
*E04F 21/00* (2006.01)

(52) U.S. Cl.
CPC ..... *E06B 1/02* (2013.01); *E04F 21/0015* (2013.01)

(58) Field of Classification Search
CPC ..... E06B 1/02; E06B 1/52; E06B 1/6038; E04F 21/0007; E04F 21/0015
USPC ..... 52/204.1, 204.2, 215, 213
See application file for complete search history.

(56) References Cited

U.S. PATENT DOCUMENTS

| | | | | | |
|---|---|---|---|---|---|
| 1,704,717 | A * | 3/1929 | Baum | 52/215 |
| 2,915,831 | A * | 12/1959 | Parker | 434/73 |
| 3,230,676 | A * | 1/1966 | Dixon | 52/223.1 |
| 3,721,055 | A * | 3/1973 | Jerchower | 52/217 |
| 4,513,549 | A * | 4/1985 | Wendt | 52/211 |
| 5,411,153 | A * | 5/1995 | Unfried | 211/188 |
| 6,148,572 | A * | 11/2000 | Ruff | 52/204.1 |
| 6,651,390 | B2 * | 11/2003 | Camperelli | 49/504 |
| 2006/0096190 | A1 * | 5/2006 | Baczuk et al. | 52/204.1 |
| 2011/0247283 | A1 * | 10/2011 | Pagett | 52/210 |

* cited by examiner

*Primary Examiner* — Brian Mattei
(74) *Attorney, Agent, or Firm* — NK Patent Law, PLLC

(57) ABSTRACT

A pre-manufactured door buck or a kit of parts is used to install a pre-sized door buck in a wall that allows a standard sized door to be installed. The door buck can include a pair of side members and a header member. Each side member can have an aperture passing through the side member. The header member can have a first end with a first tenon and a second end with a second tenon. The door buck is constructed by inserting the first tenon and the second tenon through the apertures in the side members and secured in place. The assembled door buck defines a pre-determined sized opening in which a door can be installed.

24 Claims, 6 Drawing Sheets

DOOR BUCK

CROSS-REFERENCE TO RELATED APPLICATIONS

This application claims priority to Canadian patent application number 2,788,254, filed on Aug. 31, 2012, the entire contents of which are hereby incorporated by reference herein.

TECHNICAL FIELD

The present invention relates to a pre-manufactured door buck for framing a doorway in an interior wall.

BACKGROUND

During the construction of residential or commercial buildings, doors are placed in interior walls by first forming a door frame in the wall before the wall has been covered in drywall or some other covering material. Then after the wall is covered in drywall or some other covering material, a door jamb is installed against the door frame and the door can be hung in the installed door jamb.

Framing the door is still commonly done from scratch. When an interior wall is to be installed, a stud wall is constructed. This stud wall is typically constructed of a 2×4 sized piece of lumber that will run along the floor (the "bottom plate"), a series of 2×4 sized pieces of lumber extending upwards from the bottom plate at regular intervals (the "studs") and a 2×4 sized piece of lumber running along the tops of the studs (the "top plate"). A second stud can be provide running along the top plate to form a double top plate. The door frame is constructed in this stud wall in the location where a door is desired. A carpenter (framer) will typically measure the space where the door will be in the stud wall and then cut out this space. Then he or she will cut studs for either side of the door and nail these studs between the bottom plate and the top plate of the stud wall to form a pair of outer studs. With an opening formed between the two outer studs, the carpenter will cut two more studs to the height of the door frame and install these studs along the outer studs to form inner studs. With these two inner studs in place, the carpenter then must form a header for the door. The carpenter can cut a stud so that it is the width of the opening formed by the outer studs and install this stud over the top of the inner studs. Additional smaller studs ("cripple studs") can be installed between the stud installed above the door opening and the top plate so that the cripple studs run vertically between the two studs on the top of the door framed opening and the top plate. Alternatively, the carpenter can form the header by cutting to 2×12 pieces of lumber to the width of the door opening formed by the outer studs, placing spacers in between these 2×12 sized pieces of lumber so that they are the same thickness as the studs and nailing this above the inner studs to form the header. The 2×12 sized pieces of lumber are positioned so that their width is positioned vertically above the door opening.

To hang the door in the door frame, the door jambs can be installed in the frame and the door hung from the door jambs.

Typically, the door frame is done all by the carpenter's measurements on site. The carpenter must measure the width of the opening he or she wants for the door frame and try to take into account the extra space needed to accommodate the door jambs. Additionally, the carpenter must take into account the width of the outer and inner studs and leave room to accommodate their width in addition to the jambs that will eventually be installed within the door frame to hang the door. Because each of the studs forming the door frame are cut for that particular door frame, any cutting error can result in an opening that is too wide (or high) resulting in a lot of additional work to be done by the finishing carpenter that has to hang the door or too narrow (or low) requiring the finishing carpenter to try and widen (or heighten) the door after the fact to get the door to fit in the frame.

With the lumber for each door frame being cut on the spot for each door frame and sized by measurements of the specific spot a lot of human error can be introduced. While a carpenter can get their frames sized properly most of the time, even the odd miss-sized door frame can add significant time and complications to hanging the door. This problem can be exasperated when less experienced carpenters are creating the door frames or construction is hurried.

DESCRIPTION OF THE DRAWINGS

A preferred embodiment of the present invention is described below with reference to the accompanying drawings, in which.

DETAILED DESCRIPTION OF THE ILLUSTRATED EMBODIMENTS

Figure 1:
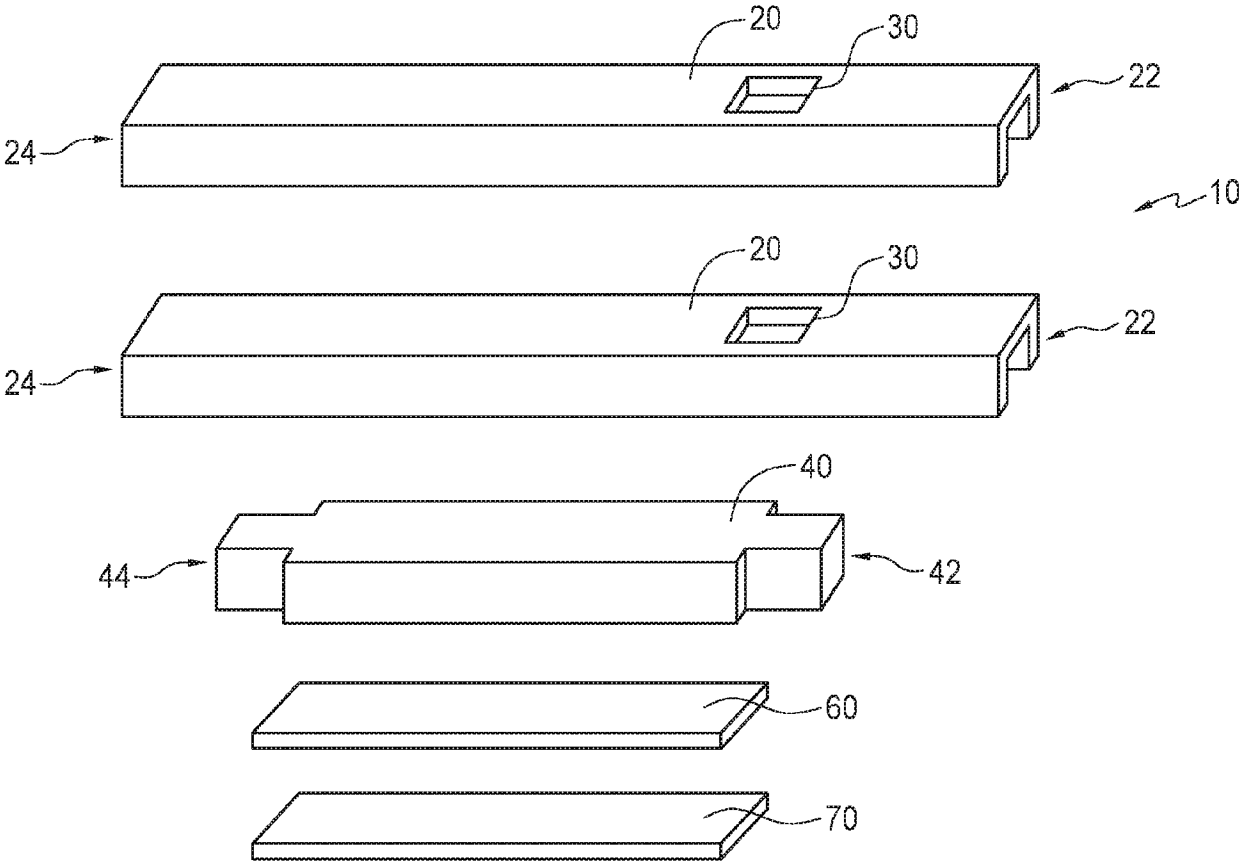
FIG. 1 is an illustrations of the unassembled components of a pre-manufactured door buck.

FIG. 1 illustrates the various components of a pre-manufactured door buck 10 for creating a door frame. The door buck 10 can be grouped as a kit of parts to be assembled at a job site and can have a pair of side members 20, a header member 40, a top panel 60 and a bottom panel 70.

Figure 2:
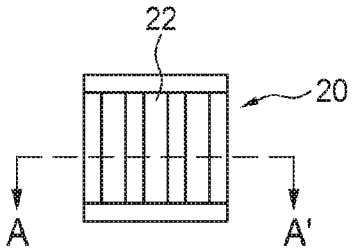
FIG. 2 is a top view of aside member of the door buck.
Figure 3:
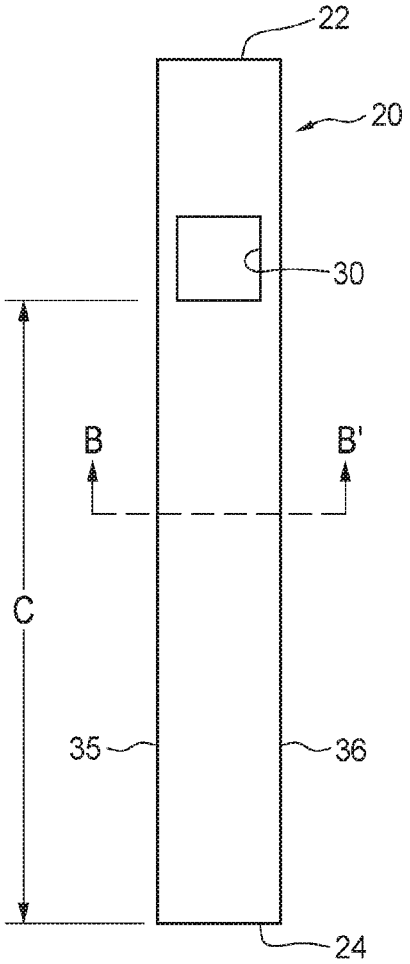
FIG. 3 is a front view of the side member of FIG. 2.

Referring to FIGS. 1-3, the side members 20 can have a top end 22 and a bottom end 24 and the side members 20 will be used to form the sides of the door frame. Each side member 20 can have an aperture 30 for receiving an end 42, 44 of the header member 40 with the aperture 30 spaced set distances from the top end 22 and the bottom end 24 of the side member 20. The distance C between the bottom end 24 of the side member 20 and the bottom of the aperture 30 will be a set distance based on the height of a door that will be installed, the clearance for the door to open and close and the moulding that will be installed above the door to the bottom of the door frame. The side members 20 will also extend for a distance above the aperture 30 so that the total height of the side member 20 can be based on typical ceiling heights.

Figure 5:
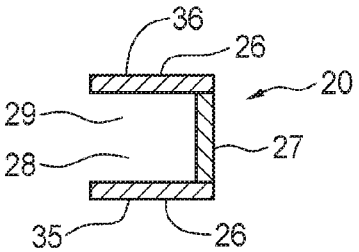
FIG. 5 is a top sectional view of the side member taken along sectional line BB' in FIG. 3.

The side members 20 can be molded from a single material or they can be assembled from panel material such as plywood, particle board, medium-density fiberboard, some other engineered wood, etc. into the final side members 20. Referring to FIG. 5, the side member 20 can be constructed so that it is formed of two sides panels 26 and a front panel 27 forming a c-shaped cross section with a hollow space 28 within the side member 30 and an open back 29. If the side member 20 is formed from panel material, the side panels 26 can be formed of panels of the panel material and the front panel 27 can be formed of a different panel.

Figure 4:
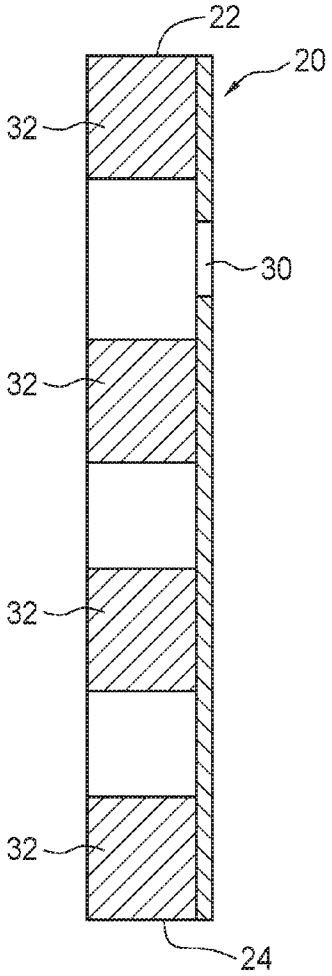
FIG. 4 is a side section view of the side member taken along sectional line AA' in FIG. 2.

Referring to FIG. 4, hinge supports 32 can be provided, filling the hollow space 28 with material. The hinge supports 32 can be positioned along the side member 20 at locations that will coincide with the hinges of the door that will be hung in the installed door buck 10 so that the screws used to attach the hinges to the door buck 10 will screw into the solid material formed by the hinge supports 32, rather than just the thin front panel 27 of the side member 20.

Figure 6:
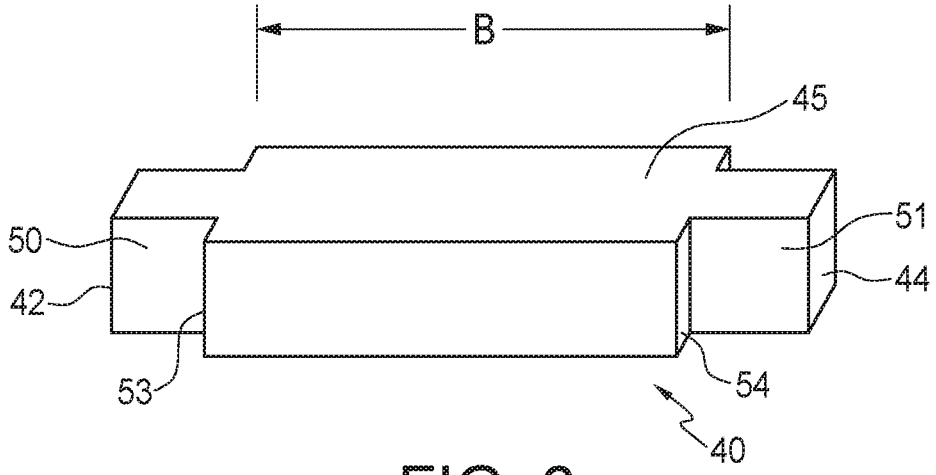
FIG. 6 is a perspective view of a header member of the door buck.
Figure 7:
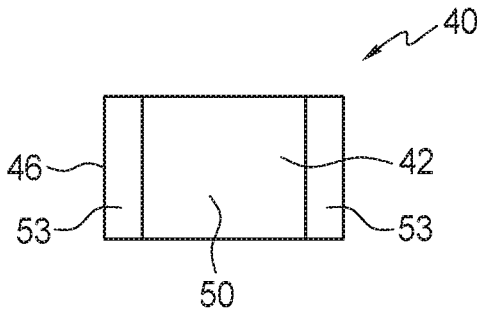
FIG. 7 is an end view of a first end of the header member of FIG. 6.

Referring to FIG. 6, the header 40 is used to form the top of the door frame. The header 40 can have a first end 42 and a second end 44 with each end forming a tenon 50, 51, respectively. Referring to FIG. 7 the tenon 45 on the first end 42 of the header member 40 can extend the full height of the header 40 but not the full width thereby forming shoulders 53, 54 on either side of the tenon 45. The shoulder 53, 54 can be sized so that outer side surfaces 45, 46 of the header member 40 will be substantially flush with side surfaces 35, 36 of the side members 20 when the tenons 45, 46 are inserted in the apertures 30 of the side members 20. The distance D defined between the shoulders 53 on the first end 42 and the shoulders 45 on the second end 44 will coincide with the width of a door to be installed, the casing of the door, etc. In one aspect, this distance D be the width of the door to be hung, plus the twice the thickness of the door jamb material (that will be used with the door to be hung) and approximately 1¼" for shimming. The shimming is required to allow the door to be hung level.

Referring again to FIG. 1 top panel 60 and the bottom panel 70 can be used to connect the top ends 22 and bottom ends 24 of the side members 20, respectively, when the door buck 10 is assembled. The top panel 60 and bottom panel 70 can be relatively thin panels.

Referring again to FIG. 1, in operation the components of the door buck 10 can be assembled on-site to define a door frame. The side members 20 and the header member 40 are sized and configured so that the width and height of the door frame that is created using the door buck 10 is a standard size and will always result in this standard size. The door buck 10 thereby eliminates any measuring and cutting to be done at the job site, merely requiring the carpenter to assemble the components of the door buck 10 into a door frame. This can allow carpenters to quickly and accurately assemble door frames using the door buck 10 with each door buck 10 achieving substantially the same size door frame opening time and time again with no measuring and cutting required. This allows the door installers to simply install the door and not have to adjust the sizing of the door frame so that the door can be hung.

Figure 8:
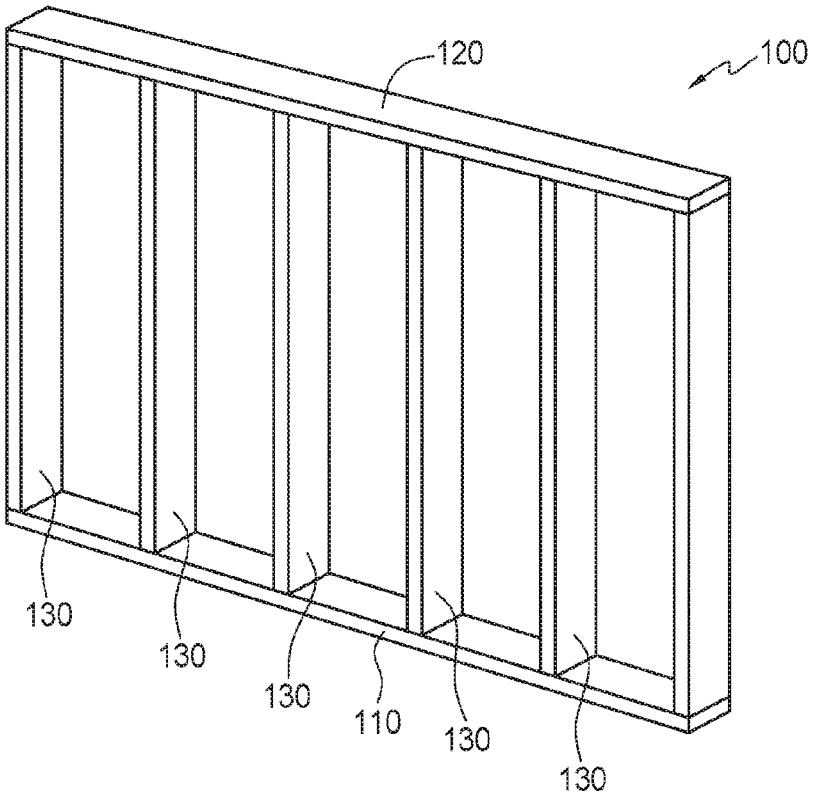
FIG. 8 is a perspective view of a stud wall.
Figure 9:
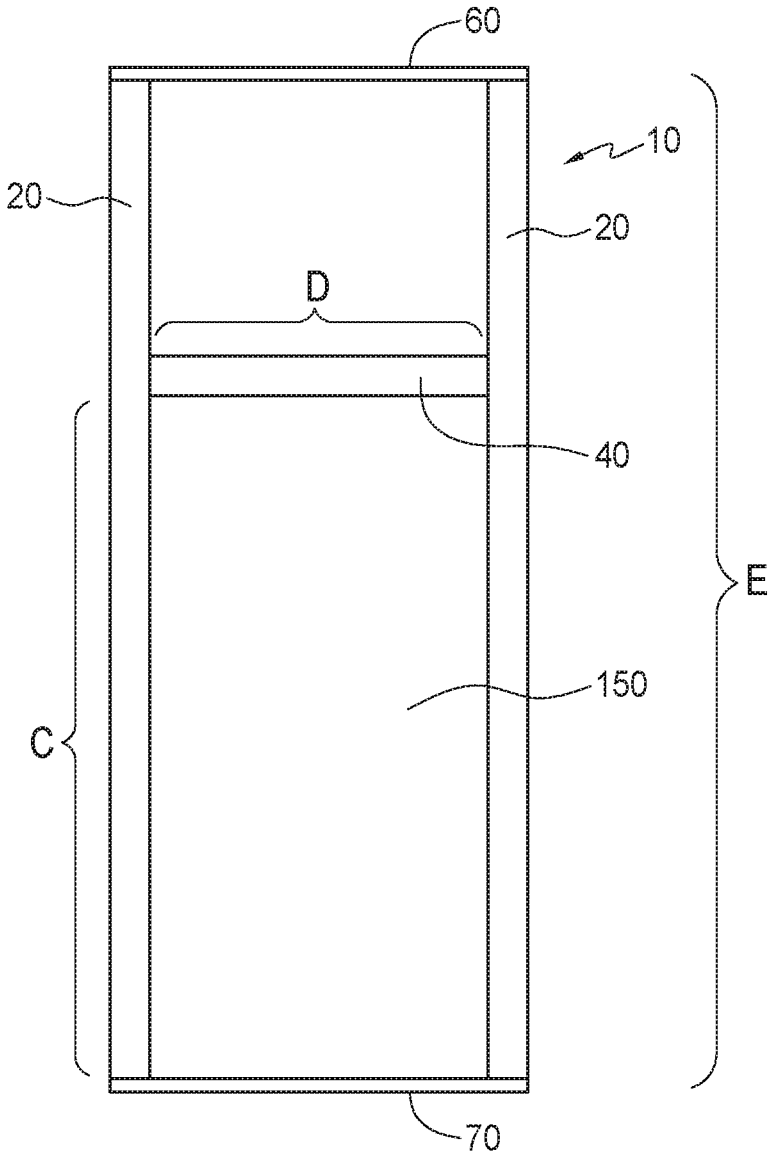
FIG. 9 illustrates an assembled door buck.

To use the door buck 10, a stud wall 100 can be assembled. Referring to FIG. 8, the stud wall 100 can have a bottom plate 110 running along the bottom of the stud wall 100, a top plate 120 running along the top of the stud wall 100 and a number of vertically oriented studs 130 extending between the bottom plate 110 and the top plate 120. Referring to FIG. 9 the door buck 10 can be assembled for installation in the stud wall 100. The ends 42, 44 of the header member 40 can be inserted in the apertures 30 of the side members 20 so that the shoulders 53, 54 of the head members 40 defined by the tenons 42, 44, respectively, abut against the front panels 27 of the side members 20. This will result in the door frame defining an opening 150 where a door (not shown) will be hung that has the width D, the distance between the shoulder 53, 54 on the header member 40. The header member 40 will maintain the side members 20 at this distance D apart from one another along the entire lengths of the side members 20. The height of the opening 150 where the door (not shown) will be hung will have the distance C. Because of the size of the shoulders 53, 54, the side surfaces 45, 46 of the header member 40 should be substantially flush with the side surfaces 35, 36 of the side members 20.

With the ends 42, 44 of the head member 40 passing through the apertures 30 in the side members 20, the head member 40 can be secured in place. In one aspect, a carpenter can drive nails through the side surfaces 35, 36 of the side members 20 behind the apertures 30 and through the side panels 26 into the tenons 42, 44 of the header member 40. This can secure the header member 40 in place relative to the side members 20.

The top panel 60 can be secured, such as by nailing, to the top ends 22 of the side members 20 and the bottom panel 70 can be secured to the bottom ends 24 of the side members 20. In one aspect, the lengths of the top panel 60 and the bottom panel 70 can be sized so that they extend a distance D plus the depth of the side members 20 so that the ends of the top panel 60 and bottom panel 70 can sit flush with the backs of the side members 20 and the distance D is maintained along the entire length of the side members 20. The door buck 10 will have a height E defined by the height of the top panel 60, the length of the side members 20 and the height of the bottom panel 70.

Figure 10:
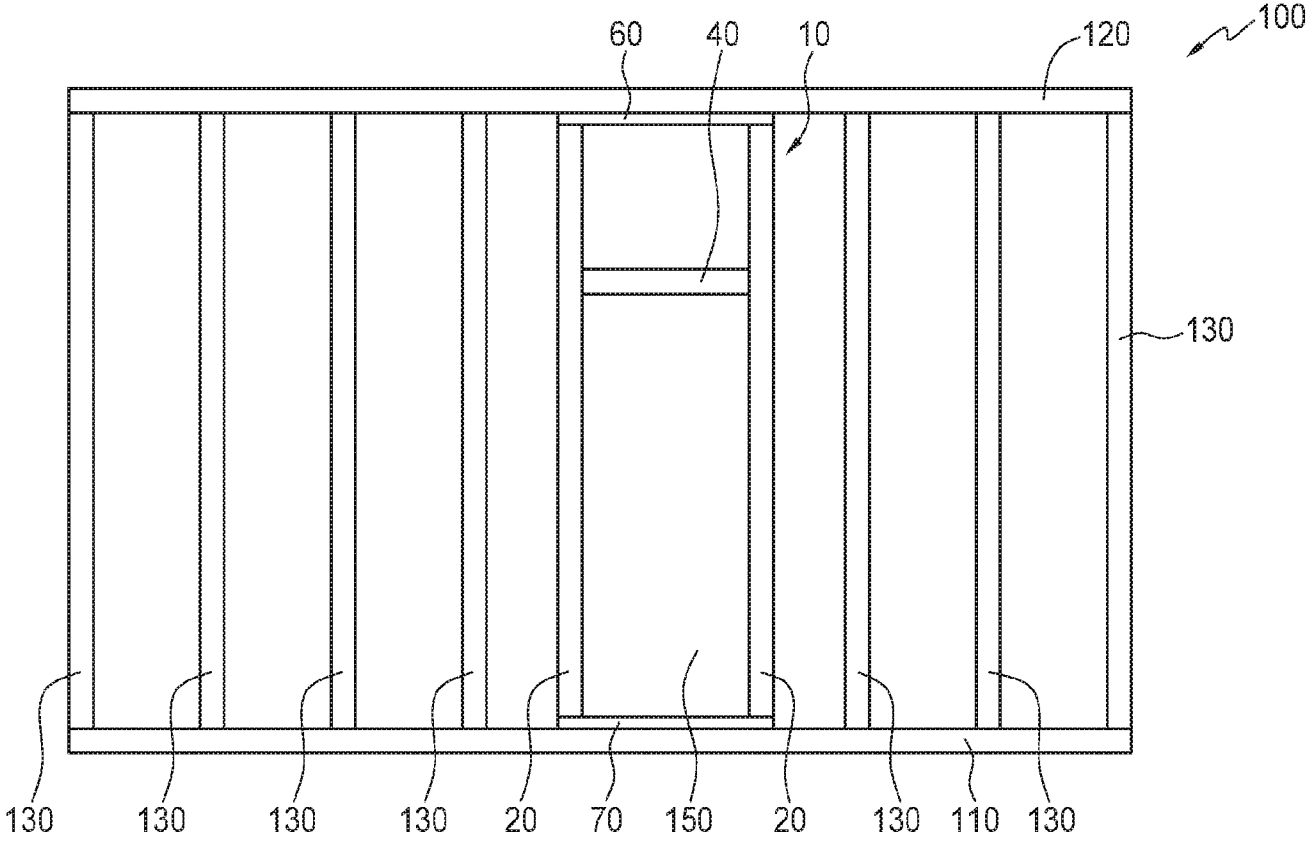
FIG. 10 illustrates the assembled door buck installed in a stud wall.

With the top panel 60 and bottom panel 70 secured in place, the door buck 10 is assembled and can be installed in the stud wall 100. Referring to FIG. 10 the assembled door buck 10 can simply be slid between the bottom plate 110 and the top plate 120 with the top of the top panel 60 positioned adjacent to the bottom of the top plate 110 and the bottom of the bottom panel 70 positioned adjacent to the top of the bottom plate 110. One in place, the door buck 10 can be secured in place in the stud wall 100, such as by nailing. The opening 150 defined by the door space 150 will be the proper size for a standardized door (not shown) to be hung. When the stud wall 100 is in place, a carpenter can cut through the bottom panel 70 and the bottom plate 110, so that the cuts are aligned with the side members 20, to open up the bottom of the door way. This door way can then be used to hang a standard sized door in.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A door buck comprising:

a pair of side members, each side member having a top end, a bottom end and an aperture passing through the side member, the aperture spaced a first distance from the bottom end of the side member; and a header member having a first end with a first tenon and a second end with a second tenon, the first tenon forming at least one first shoulder at the first end of the header member and the second tenon forming at least one second shoulder at the second end of the header member, the header member extending a second distance between the first shoulder and the second shoulder, the first tenon and the second tenon sized to fit through the apertures in the side members, wherein the first distance and the second distance define a space in which a door will be installed, wherein the apertures in the pair of side members are positioned so that the top ends of each of the pair of side members extend above an uppermost surface of the header member when the header member is attached to the pair of side members by inserting the first tenon and the second tenon through the apertures in the pair of side members.

2. The door buck of claim 1 further comprising a top panel extending greater than the second distance and a bottom panel extending greater than the second distance.

3. The door buck of claim 1 further comprising a door having a height and wherein the first distance will be based on the height of the door.

4. The door buck of claim 3 further comprising a moulding and wherein the first distance is the height of the door, clearance for the door to be opened and closed and a space for the moulding installed above the door.

5. The door buck of claim 3 wherein the second distance is based on a width of the door to be installed in the door buck.

6. The door buck of claim 5 further comprising door jamb material having a thickness and wherein the second distance is the width of the door to be installed in addition to twice the thickness of the door jamb material and space for shimming.

7. The door buck of claim 1 wherein each side member is formed of a pair of side panels and a front panel, and wherein the aperture is provided passing through the front panel.

8. The door buck of claim 7 wherein the top panel and the bottom panel extend the second distance plus the depth of each side members.

9. The door buck of claim 7 wherein the side member has a c-shaped cross section defining a hollow space formed within the side members and the open back.

10. The door buck of claim 7 further comprising hinge supports provided between the side panels to fill in the hollow with material.

11. The door buck of claim 7 wherein each side member is molded from a single material.

12. The door buck of claim 1 wherein the first tenon and the second tenon extend the full height of the header member and shoulders are formed between outer surfaces of the header member and the first tenon and second tenon.

13. The door buck of claim 12 wherein the outer side surfaces of the header member are positioned so that the outer side surfaces of the header member are substantially flush with the side panels of the side members when the first tenon and second tenor are inserted in the apertures in the side members.

14. The method of claim 1 wherein the top end of each of the pair of side members is configured to:

receive a top panel extending therebetween; and form an opening defined by the top panel, the portion of the side members extending above a top surface of the header member, and the header member.

15. A kit of parts for constructing a door buck, the kit comprising:

a pair of side members, each side member having a top end, a bottom end and an aperture passing through the side member, the aperture spaced a first distance from the bottom end of the side member; and a header member having a first end with a first tenon and a second end with a second tenon, the first tenon forming at least one first shoulder at the first end of the header member and the second tenon forming at least one second shoulder at the second end of the header member, the header member extending a second distance between the first shoulder and the second shoulder, the first tenon and the second tenon sized to fit through the apertures in the side members, wherein the first distance and the second distance define a space in which a door will be installed and wherein the apertures in the pair of side members are positioned so that the top ends of each of the pair of side members extend above an uppermost surface of the header member when the header member is attached to the pair of side members by inserting the first tenon and the second tenon through the apertures in the pair of side members.

16. The kit of claim 15 further comprising a top panel extending greater than the second distance and a bottom panel extending greater than the second distance.

17. The kit of claim 15 further comprising a door having a height and wherein the first distance will be based on the height of the door.

18. The kit of claim 17 wherein the second distance is based on a width of the door to be installed in the door buck.

19. The kit of claim 15 wherein each side member is formed of a pair of side panels and a front panel, and wherein the aperture is provided passing through the front panel.

20. The kit of claim 19 wherein the top panel and the bottom panel extend the second distance plus the plus the depth of each side members.

21. The kit of claim 19 wherein the side members further comprise hinge supports provided between the side panels to fill in the hollow with material.

22. The kit of claim 19 wherein each side member is molded from a single material.

23. The kit of claim 15 wherein the first tenon and the second tenon of the header member extend the full height of the header member and shoulders are formed between outer surfaces of the heard and the first tenon and second tenon.

24. The kit of claim 23 wherein the outer side surfaces of the header member are positioned so that the outer side surfaces of the header member are substantially flush with the side panels of the side members when the first tenon and second tenon are inserted in the apertures in the side members.

* * * * *